US012529230B2

(12) United States Patent
Naylor et al.

(10) Patent No.: US 12,529,230 B2
(45) Date of Patent: Jan. 20, 2026

(54) GUARDRAIL FORMED FROM FOLDED SHEET METAL

(71) Applicant: Bok Modern LLC, San Rafael, CA (US)

(72) Inventors: Russell Naylor, San Rafael, CA (US); Alan Beirne, Los Angeles, CA (US)

(73) Assignee: BOK Modern LLC, San Rafael, CA (US)

( * ) Notice: Subject to any disclaimer, the term of this patent is extended or adjusted under 35 U.S.C. 154(b) by 406 days.

(21) Appl. No.: 17/985,072

(22) Filed: Nov. 10, 2022

(65) Prior Publication Data

US 2023/0144870 A1 May 11, 2023

Related U.S. Application Data

(60) Provisional application No. 63/263,880, filed on Nov. 10, 2021.

(51) Int. Cl.
*E04F 11/18* (2006.01)

(52) U.S. Cl.
CPC ... *E04F 11/1851* (2013.01); *E04F 2011/1889* (2013.01)

(58) Field of Classification Search
CPC ..... E04F 2011/1889; E04F 11/1851; E04F 11/1855; E04H 17/1417; E04H 17/161; E04H 17/163; E04H 17/164; E04H 17/165
See application file for complete search history.

(56) References Cited

U.S. PATENT DOCUMENTS

| | | | | |
|---|---|---|---|---|
| D270,285 | S | 8/1983 | Demarest | |
| 5,190,268 | A * | 3/1993 | Espinueva | E04H 17/1417 256/65.01 |
| D355,261 | S | 2/1995 | Abrams et al. | |
| D415,842 | S | 10/1999 | Mishina | |
| D422,088 | S | 3/2000 | Mishina | |
| D422,367 | S | 4/2000 | Mishina | |
| D446,315 | S | 8/2001 | Forbis | |
| D509,594 | S | 9/2005 | Curtas et al. | |
| 7,111,584 | B2 | 9/2006 | Wang | |
| D543,639 | S | 5/2007 | Mertins | |
| 7,316,749 | B2 * | 1/2008 | Smith | E04B 1/34321 52/762 |
| 7,585,368 | B2 * | 9/2009 | Lin | B05B 15/80 118/500 |
| 7,913,960 | B1 | 3/2011 | Herr, III et al. | |

(Continued)

FOREIGN PATENT DOCUMENTS

| | | | | |
|---|---|---|---|---|
| DE | 102011121073 A1 * | 3/2013 | | E04F 11/025 |
| GB | 2440335 A * | 1/2008 | | E04B 1/6129 |

*Primary Examiner* — Matthew R Mcmahon
(74) *Attorney, Agent, or Firm* — Patrick Sheldrake

(57) ABSTRACT

A guardrail formed of folded sheet metal includes a face panel, a top panel extending rearwardly from the top edge of the face panel, a return panel extending downwardly from a return edge of the face panel, the return edge being opposite the top edge, and an end panel extending rearwardly from a side edge of the face panel and having the same width as the distance as the distance between the front surface of the face and the back surface of the return panel, the end panel having an upwardly extending upper portion being narrower than the main body of the end panel so that it is freely received in a downwardly facing channel formed by the face, top and return panels.

20 Claims, 5 Drawing Sheets

(56) References Cited

U.S. PATENT DOCUMENTS

| | | | | |
|---|---|---|---|---|
| 7,950,095 | B2 * | 5/2011 | Honeycutt | B21D 5/00 182/2.1 |
| 8,167,275 | B1 | 5/2012 | Bizzarri et al. | |
| D757,297 | S | 5/2016 | Che | |
| 9,932,734 | B1 | 4/2018 | Winter | |
| D828,928 | S | 9/2018 | Tamillow et al. | |
| 10,174,498 | B2 | 1/2019 | Winter | |
| 10,358,871 | B2 * | 7/2019 | Honeycutt | E04G 7/02 |
| D1,014,784 | S * | 2/2024 | Naylor | D25/38.1 |
| 2006/0041448 | A1 | 2/2006 | Patterson et al. | |
| 2009/0144916 | A1 | 6/2009 | Honeycutt et al. | |
| 2010/0237309 | A1 | 9/2010 | Ferris et al. | |
| 2013/0292624 | A1 | 11/2013 | Bergman | |
| 2014/0326537 | A1 | 11/2014 | Honeycutt | |
| 2020/0080620 | A1 | 3/2020 | Graber et al. | |

* cited by examiner

GUARDRAIL FORMED FROM FOLDED SHEET METAL

CROSS-REFERENCE TO RELATED APPLICATIONS

This application claims the benefit of U.S. Provisional Application No. 63/263,880, filed Nov. 10, 2021, which is incorporated herein by reference.

BACKGROUND

Technical Field

The present invention relates generally to building construction and more particularly to guardrails and guard barriers formed from folded sheet metal.

Description of Related Art

Guard barriers and guardrails may be formed by folding top and edge panels relative to a face panel from a single piece of sheet metal to form a corner as seen in FIG. 1. The result is somewhat unrefined and unsightly and can present a rough edge to the hand at the corner.

DETAILED DESCRIPTION OF THE ILLUSTRATED EMBODIMENT

Figure 1:
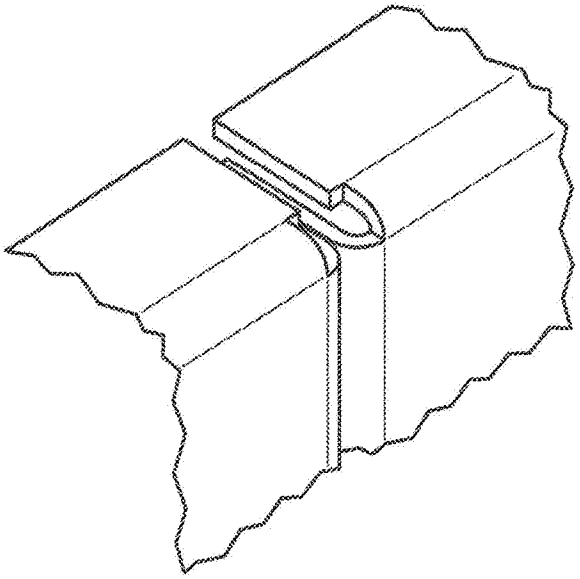
FIG. 1 (PRIOR ART)
FIG. 1 is an upper perspective view of the upper corners of a prior art guardrail.
Figure 2:
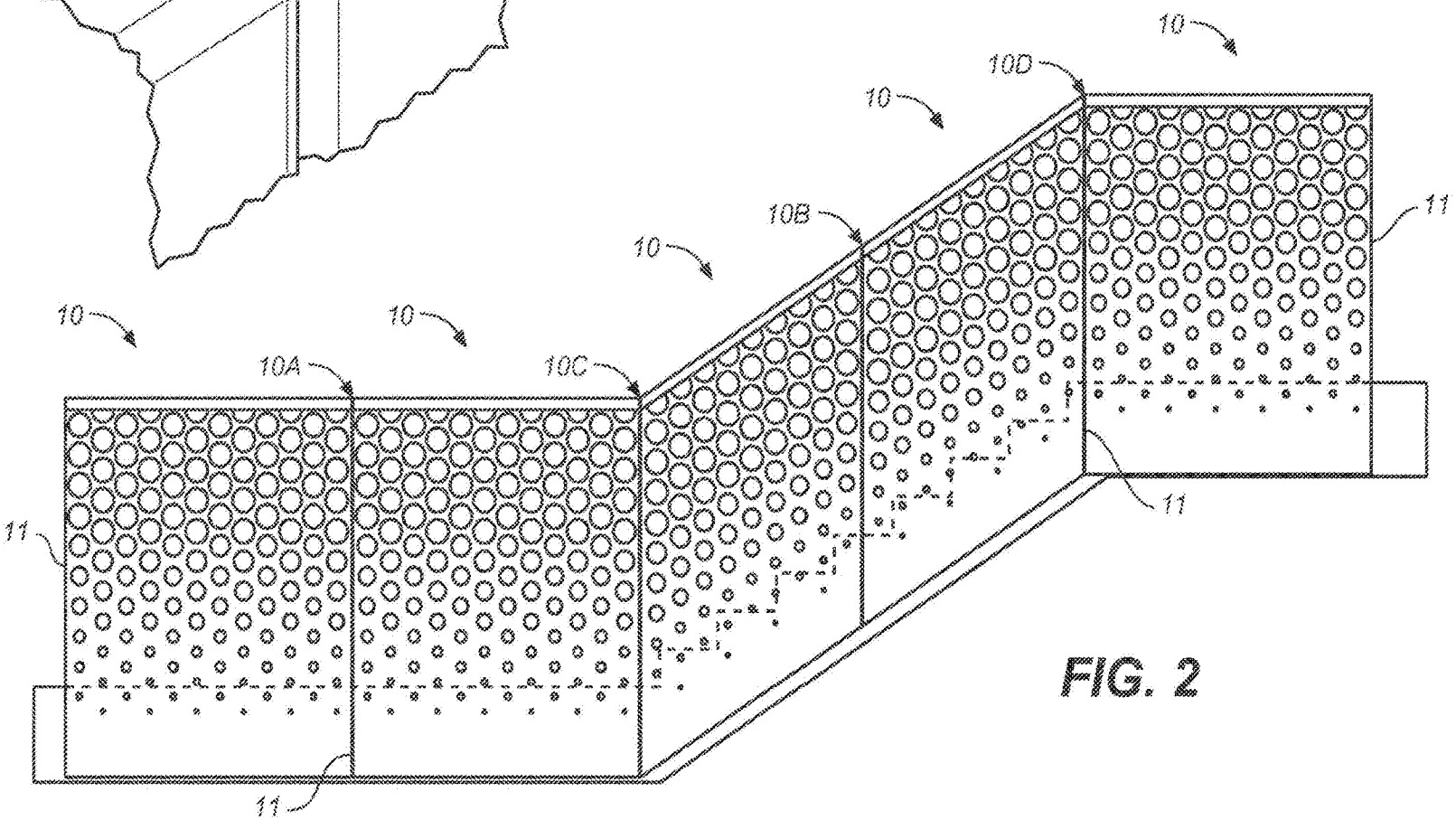
FIG. 2 is an elevational view of multiple sections of a guardrail according to the invention interconnected to form a barrier.

A guardrail 10 according to the invention is shown in FIGS. 2-8. Multiple sections of a guardrail 10 when interconnected form a guard barrier as seen in FIG. 2. Each guardrail section in the illustrated embodiment is formed by folding a unitary blank of sheet metal. Each guardrail 10 includes abutting edges 11 for attachment of two adjacent guardrails, and each edge 11 may also form a presentation end as shown. As seen in FIG. 2, abutting sections of the guardrail may both be rectangular, as at 10A, may both be angled, as at 10B, or may be a combination of horizontal and angled as at 10C and 10D.

Figure 4:
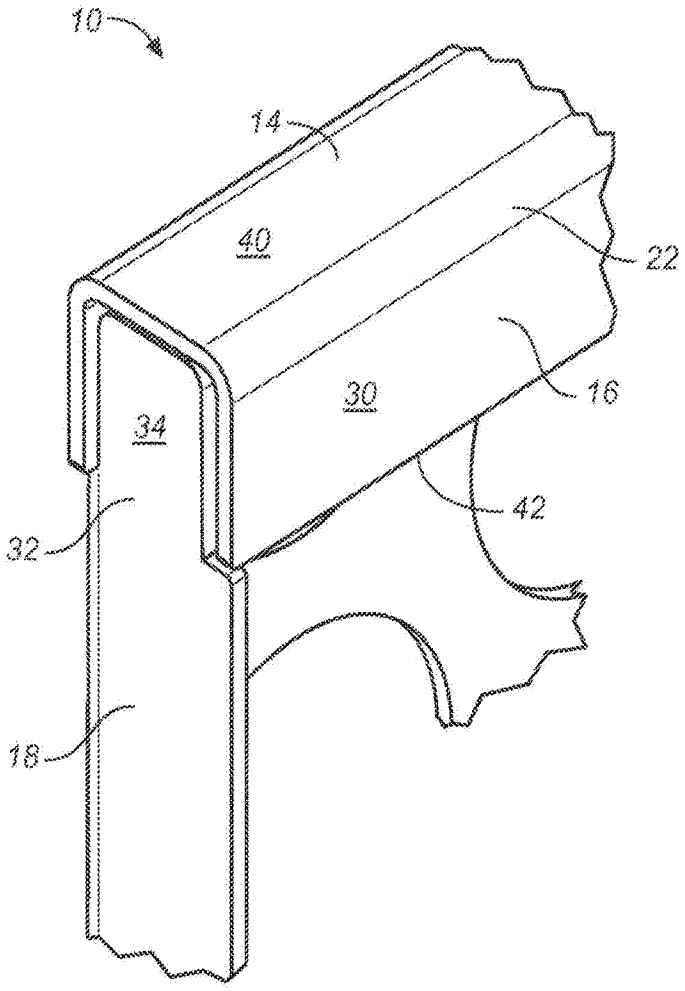
FIG. 4 is an upper right perspective view thereof.
Figure 3:
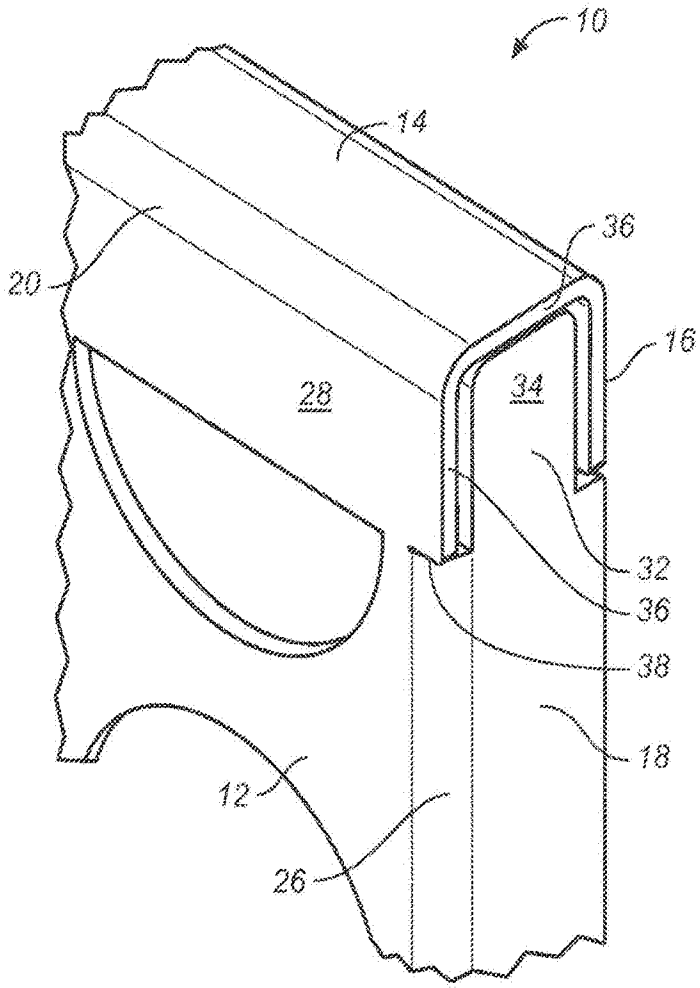
FIG. 3 is an upper left perspective view of a corner of a guardrail according to the invention.
Figure 5:
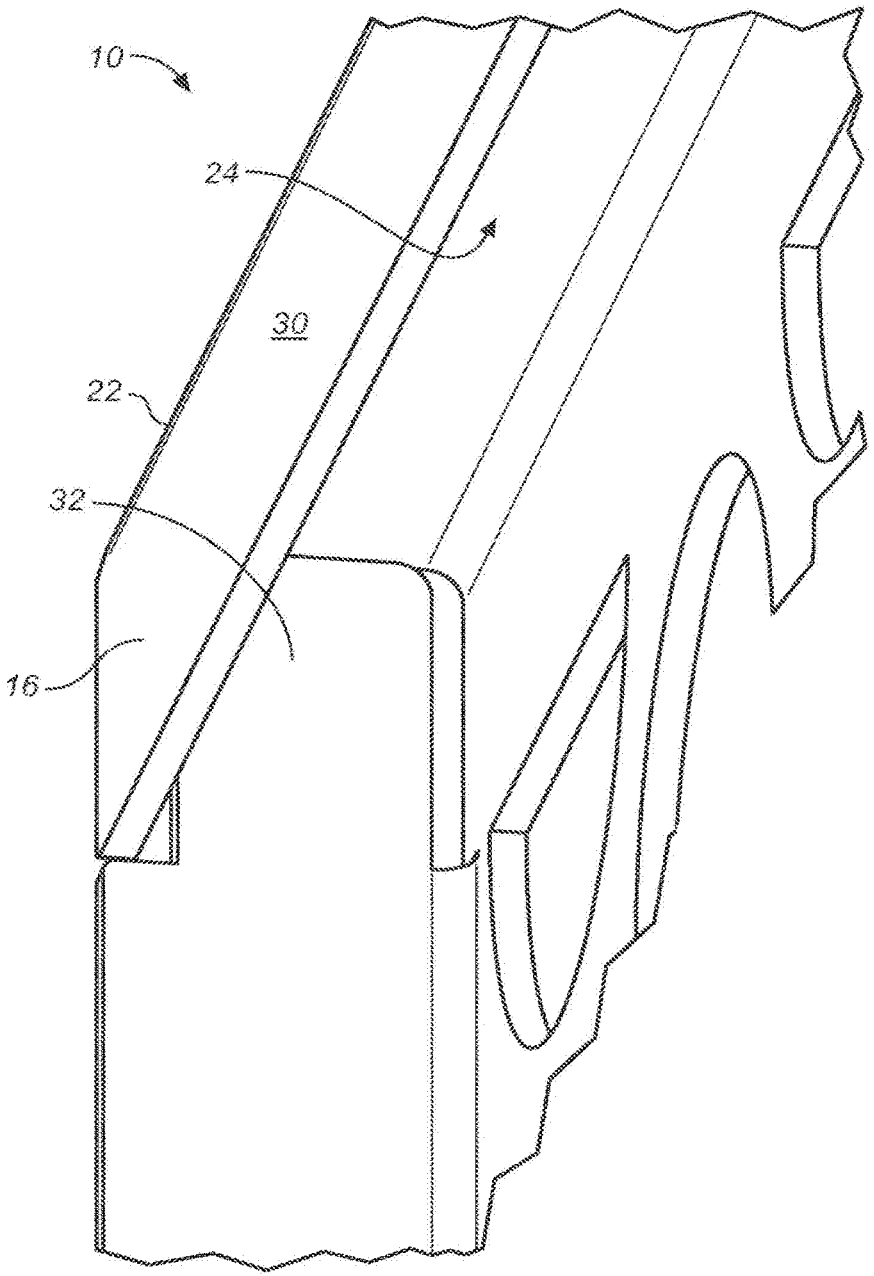
FIG. 5 is a bottom right perspective view thereof.

Referring now to FIGS. 3-5, according to the invention a guardrail 10 comprises a face panel 12, a top panel 14, a return panel 16, and an end panel 18. The face panel 12 is vertically disposed and generally extends from or near a ground surface such as a floor, walkway, or stairs, but could extend downward any lesser distance from the top panel 14. It may have a pattern such as the hole pattern seen in FIGS. 3-7, may have a surface embellishment, or may be unadorned. In the illustrated embodiment all the panels 12, 14, 16, 18 are formed by folding a sheet metal blank (not illustrated) which has been laser cut to specification. However, the scope of the invention includes guardrails formed by methods other than folding.

The top panel 14 extends horizontally from the top edge 20 of the face panel 12 and the return panel 16 extends downwardly from the return edge 22 of the top panel. The top part of the face panel 12 together with the top panel 14 and return panel 16 form a downwardly oriented channel 24 as seen in FIG. 5. In the illustrated embodiment, the top panel 14 is perpendicular to the face panel 12, and the return panel is parallel with the face panel 12, but other angular relationships are contemplated to be within the scope of the invention.

The end panel 18 extends from the side edge 26 of the face panel 12 as best seen in FIG. 3. In the illustrated embodiment, the end panel 18 is perpendicular to the face panel 12, but other angles are contemplated to be within the scope of the invention.

Figure 6:
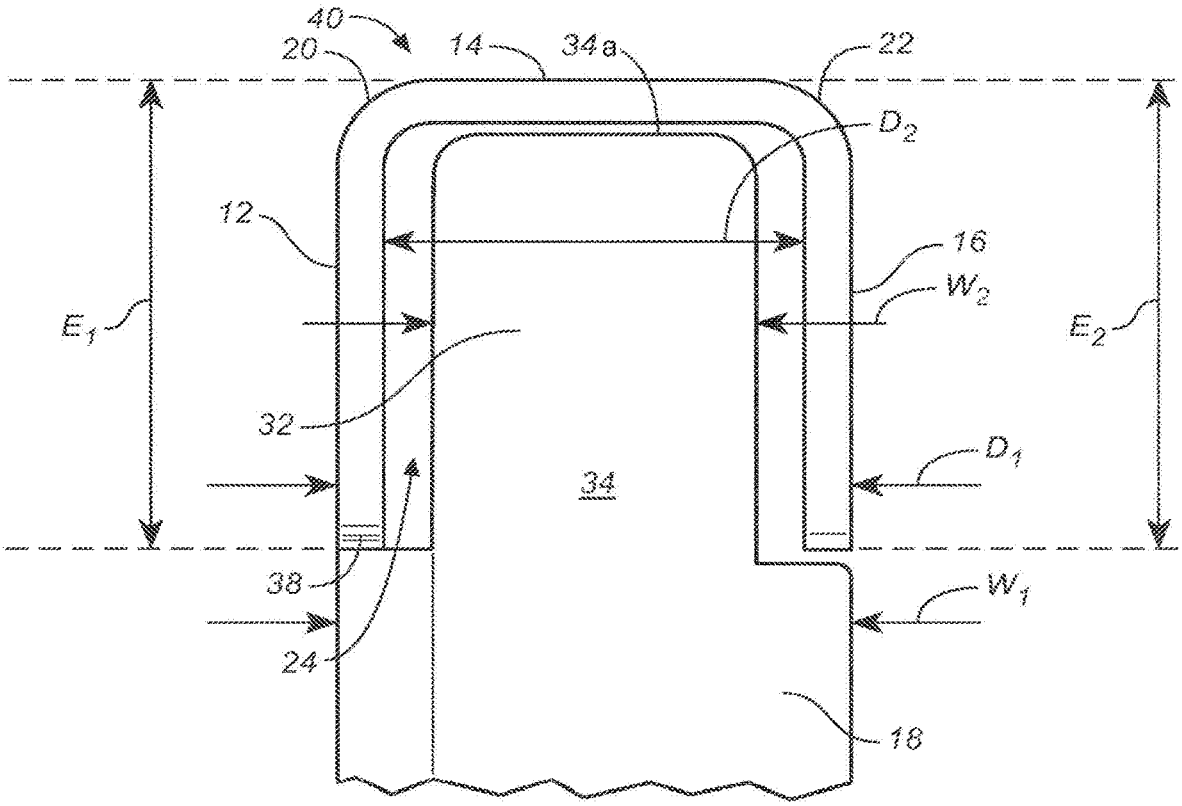
FIG. 6 is an end view thereof.

With additional reference to FIG. 6, the end panel 18 has a width $W_1$ that is the same as the distance $D_1$ between the front surface 28 of the face panel 12 and the back surface 30 of the return panel.

Figure 7:
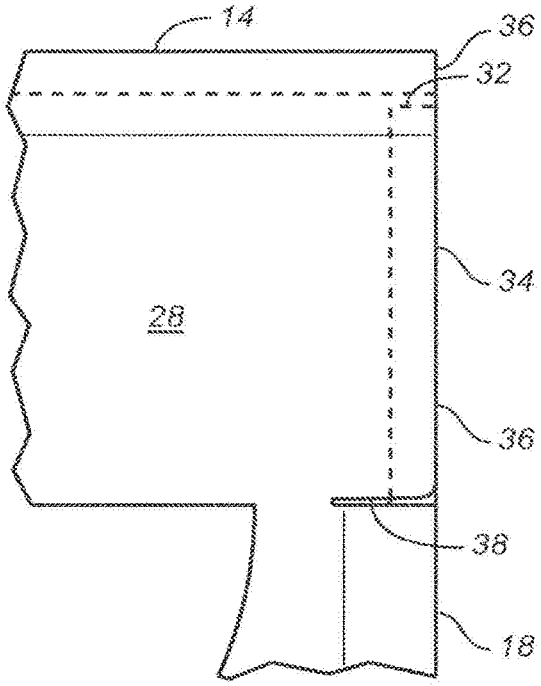
FIG. 7 is an elevation view thereof.

In FIG. 7 it is seen that the end panel 18 has an upper portion 32 having a width $W_2$ that is narrower than the width $W_1$ of the rest of the end panel below it and is narrower than the distance $D_2$ between the face panel 12 and the return panel 16. In addition, the top edge 34*a* of the upper portion 32 is spaced from the top panel 14. The upper portion is thus dimensioned to be freely received in the channel 24 formed by the face, top and return panels 12, 14, 16 as shown.

Figure 8:
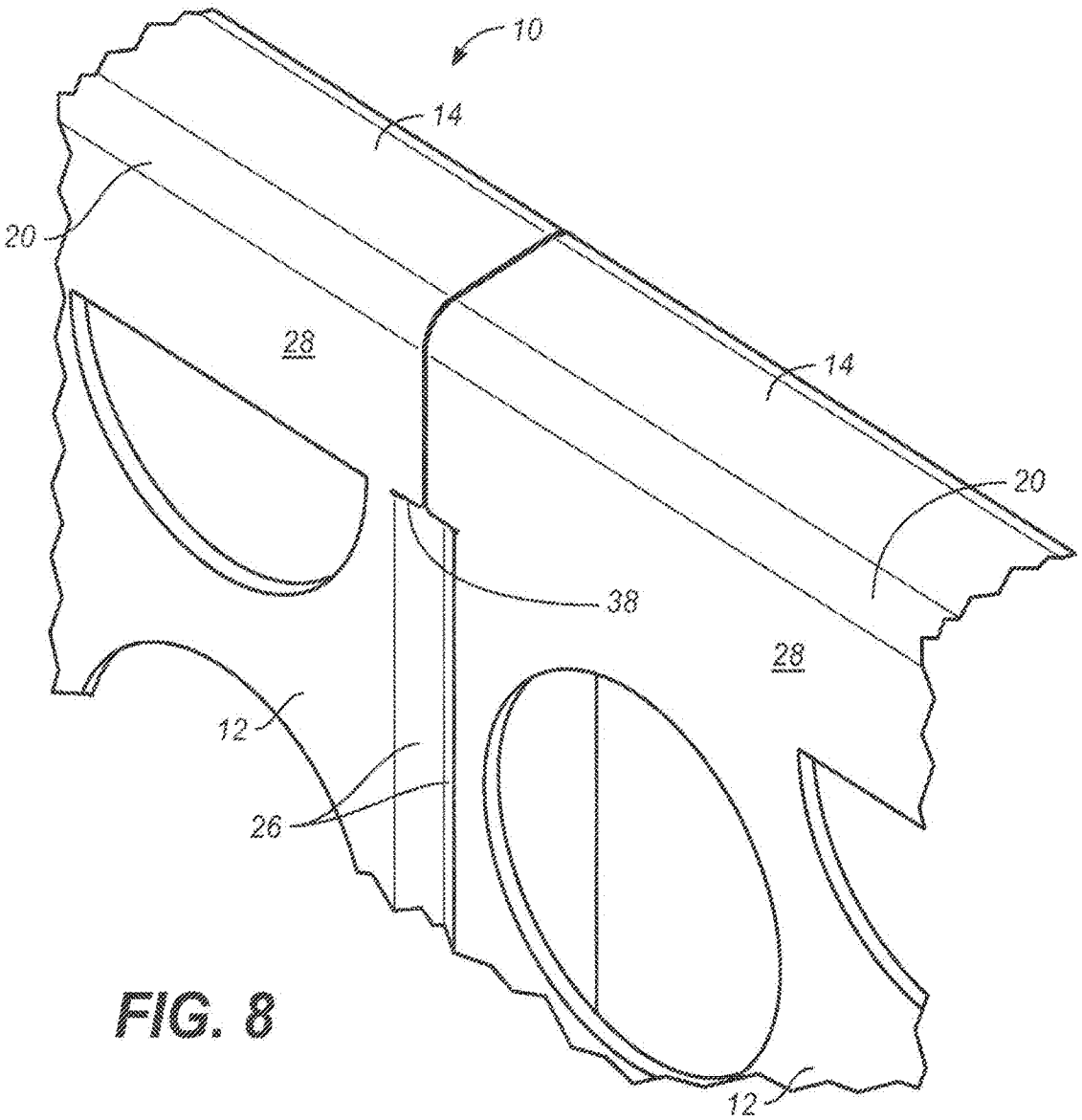
FIG. 8 is an upper right perspective view of the upper corners of two adjoining guardrails according to the invention.

As seen in FIGS. 3, 4 and 6, the end surface 34 of the upper portion 32 of the end panel 18 is coplanar with end edges 36 of the face, top and return panels 12, 14, 16 to present a uniformly dimensioned substantially flush end face that is aesthetically pleasing but also facilitates secure attachment together of abutting sections of guardrails 10 as seen in FIGS. 2 and 8.

As can perhaps best be seen in FIGS. 3-5, end panel 18 is formed by bending along the side edge 26 of face panel 12 below bend relief 38, above which the upper portion 32 of the end panel 18 is spaced from face panel 12. As seen in FIG. 6, the bend relief 38 is located below the top surface 40 of top panel 14 a distance $E_1$ that is substantially the same as the vertical dimension $E_2$ from the top surface 40 of top panel 14 to the bottom edge 42 of return panel 16, thereby giving the visual impression of a hand-holdable guard rail formed together by the top part of face panel 12 and the return panel 16.

Although the discussion above focuses primarily on guardrails having a horizontal top panel, by forming the top panel at an angle with respect to the end panel guardrail sections can be formed for use with angled structures such as stairs and ramps as seen in FIG. 2.

A guardrail as described above essentially moves the location of the bend relief downward from the corner, as it is found in the prior art, to a distance below the top panel that is matched by the vertical width of the return panel. The location of the bend relief together with the width of the return panel give the impression of a handrail. Moving the bend relief down from the top panel and tucking the upper part of the end panel in the channel formed by the face, top and return panels provides a smooth transition between adjoining corners and, by minimizing the bend relief, is more aesthetically pleasing than a prior art guardrail. Manufacturing of a guardrail according to the invention is simple once the sheet metal blank has been cut to specifications, and installation is quick and easy because each guardrail needs merely to be bolted down to pre-installed bolts in a support surface.

There have thus been described and illustrated certain embodiments of a guardrail formed from folded sheet metal according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

The invention claimed is:

1. A guardrail formed of folded sheet metal comprising:
a vertically disposed face panel having a top edge, a side edge, and a front surface,
a top panel extending rearwardly from the top edge of the face panel, the top panel having a return edge opposite the top edge of the face panel,
a return panel extending vertically from the return edge of the top panel, the return panel having a back surface,
an end panel extending rearwardly from the side edge of the face panel, the end panel having the same width as the distance between the front surface of the face panel and the back surface of the return panel, the end panel including an upwardly extending upper portion,
wherein the face panel, top panel, and return panel form a U-shaped channel, the upper portion of the end panel freely received in the channel,
wherein the end panel defines a recessed portion adjacent the return panel between the upper portion and the lower portion of the end panel, the recessed portion extending to a side edge of the end panel that aligns with the back surface of the return panel;
wherein the upper portion of the end panel is configured to move between a flat state and an installed state independently from the top panel; and
wherein the top panel, return panel, and end panel are defined by folded sections of a sheet metal blank.

2. The guardrail of claim 1 further comprising:
the face, top and return panels having end edges, and
the upper portion of the end panel including an end surface flush with the end edges of the face, top and return panels.

3. The guardrail of claim 2 further comprising:
a bend relief disposed along the side edge of the face panel at a distance from the top edge thereof,
wherein the end panel is bent rearwardly from the face panel along the side edge at the bend relief, and
wherein the upper portion of the end panel defines a front edge, an end panel top edge, and a back edge that are spaced from the face panel, top panel, and return panel.

4. The guardrail of claim 3 wherein:
the return panel has a bottom edge, and wherein the distance from said bottom edge to the top panel is substantially the same as the distance from the bend relief of the face panel to the top panel.

5. The guardrail of claim 2 wherein the end surface of the upper portion of the end panel is coplanar with end edges of the face panel, top panel, and return panel.

6. The guardrail of claim 1 wherein the top panel is disposed perpendicularly to the face panel.

7. The guardrail according to claim 1, wherein the top panel is continuous.

8. The guardrail according to claim 1, wherein the face panel is discontinuous.

9. A guardrail comprising:
a sheet metal blank comprising a plurality of fold lines defining:
a top panel;
a face panel extending from the top panel, the face panel configured to extend perpendicular relative to the top panel;
a return panel opposing the face panel, the return panel configured to extend perpendicular relative to the top panel;
an end panel extending from a side edge of the face panel, the end panel configured to extend perpendicular relative to the face panel;
wherein the end panel defines an upper portion and a lower portion having a greater width than the upper portion;
wherein the top panel, the face panel, and the return panel are configured to define a channel;
wherein the channel is configured to receive the upper portion of the end panel;
wherein the upper portion of the end panel is configured to move between a flat state and an installed state independently from the top panel;
wherein the end panel defines a recessed portion adjacent the return panel between the upper portion and the lower portion of the edge panel; and
wherein an end portion of the return panel is configured to nest within the recessed portion of the end panel.

10. The guardrail according to claim 1, wherein a top edge of the upper portion of the end panel is offset from the top panel such that a gap is defined between the top edge of the upper portion of the end panel and the top panel.

11. The guardrail according to claim 1, wherein an end portion of the return panel is configured to nest within the recessed portion of the end panel.

12. A guardrail formed of folded sheet metal comprising:
a vertically disposed face panel having a top edge, a side edge, and a front surface,
a top panel extending rearwardly from the top edge of the face panel, the top panel having a return edge opposite the top edge of the face panel,
a return panel extending vertically from the return edge of the top panel and parallel with the face panel, the return panel having a back surface and a bottom edge,
an end panel extending rearwardly from the side edge of the face panel, the end panel having the same width as the distance between the front surface of the face panel and back surface of the return panel, the end panel including an upwardly extending upper portion having an end surface,
a bend relief disposed along the side edge of the face panel at a distance from the top edge thereof, the end panel bent rearwardly from the face panel along the side edge at the bend relief, the distance from the bottom edge of the return panel to the top panel substantially the same as the distance from the bend relief of the face panel to the top panel,
the face, top and return panels having end edges, the end surface of the upper portion of the end panel flush with the end edges of the face, top and return panels, and
the face, top and return panels forming a U-shaped channel, the upper portion of the end panel freely received in the channel;
wherein the upper portion of the end panel is configured to move between a flat state and an installed state independently from the top panel;

wherein the end panel defines a recessed portion adjacent the return panel between the upper portion and the lower portion of the edge panel; and wherein an end portion of the return panel is configured to nest within the recessed portion of the end panel.

13. The guardrail according to claim 12, wherein the top panel is continuous.

14. The guardrail according to claim 12, wherein the face panel is discontinuous.

15. The guardrail according to claim 12, wherein the upper portion of the end panel defines a front edge, an end panel top edge, and a back edge that are spaced from the face panel, top panel, and return panel.

16. The guardrail according to claim 9, wherein an end portion of the return panel freely nests within the recessed portion such that the end portion of the return panel is spaced from the recessed portion of the end panel.

17. The guardrail according to claim 16, wherein the top panel is continuous.

18. The guardrail according to claim 16, wherein the face panel is discontinuous.

19. The guardrail according to claim 16, wherein the face panel defines a plurality of apertures.

20. The guardrail according to claim 16, wherein the sheet metal blank further defines a cutout extending between the face panel and the end panel.

* * * * *